US011174577B2

(12) United States Patent
Matsumoto et al.

(10) Patent No.: US 11,174,577 B2
(45) Date of Patent: Nov. 16, 2021

(54) BRUSHED CIRCULAR KNITTED FABRIC

(71) Applicants: Mitsukawa & Co., Ltd., Echizen (JP); Toray Industries, Inc., Tokyo (JP)

(72) Inventors: Shigeto Matsumoto, Echizen (JP); Hiroshi Tanaka, Echizen (JP); Masanobu Sato, Tokyo (JP); Takashi Kawasaki, Osaka (JP)

(73) Assignees: Mitsukawa & Co., Ltd., Echizen (JP); Toray Industries, Inc., Tokyo (JP)

( * ) Notice: Subject to any disclaimer, the term of this patent is extended or adjusted under 35 U.S.C. 154(b) by 800 days.

(21) Appl. No.: 15/748,695

(22) PCT Filed: Jul. 21, 2016

(86) PCT No.: PCT/JP2016/071346
§ 371 (c)(1),
(2) Date: Jan. 30, 2018

(87) PCT Pub. No.: WO2017/018305
PCT Pub. Date: Feb. 2, 2017

(65) Prior Publication Data

US 2019/0003087 A1 Jan. 3, 2019

(30) Foreign Application Priority Data

Jul. 30, 2015 (JP) ..... JP2015-150583

(51) Int. Cl.

| | |
|---|---|
| ***D04B 1/04*** | (2006.01) |
| ***D04B 1/10*** | (2006.01) |
| ***D04B 1/16*** | (2006.01) |
| ***D04B 1/24*** | (2006.01) |
| ***D04B 1/18*** | (2006.01) |

(52) U.S. Cl.
CPC ..... *D04B 1/246* (2013.01); *D04B 1/04* (2013.01); *D04B 1/102* (2013.01); *D04B 1/16* (2013.01); *D04B 1/18* (2013.01); *D10B 2331/04* (2013.01); *D10B 2403/0111* (2013.01);
(Continued)

(58) Field of Classification Search
CPC ..... D03D 1/04
See application file for complete search history.

(56) References Cited

FOREIGN PATENT DOCUMENTS

| | | |
|---|---|---|
| JP | 55-116091 U | 8/1980 |
| JP | 05-287667 A | 11/1993 |

(Continued)

OTHER PUBLICATIONS

Misukawa et al. JP 2991373 B English Machine Translation (Year: 1999).*

*Primary Examiner* — Jenna L Johnson
(74) *Attorney, Agent, or Firm* — DLA Piper LLP (US)

(57) ABSTRACT

A brushed circular knitted fabric has double loops stacked with at least two kinds of synthetic fiber multifilaments, wherein at least one surface of the circular knitted fabric has undergone brush processing, and the FT index represented by the equation (T2/T1) [T1: thickness (of one layer) according to a method prescribed by JIS, T2: thickness according to the same method prescribed by JIS at a state where the fabric is folded in two] is 2.1 or greater. The brushed circular knitted fabric has resiliency feeling and stretchability suitable for use in a coat or jacket, and is excellent in physical properties such as pilling resistance and changes in dimensions with washing.

8 Claims, 4 Drawing Sheets

(52) U.S. Cl.
CPC ..... *D10B 2403/0121* (2013.01); *D10B 2403/023* (2013.01); *Y10T 442/438* (2015.04); *Y10T 442/45* (2015.04)

(56) References Cited

FOREIGN PATENT DOCUMENTS

| | | | |
|---|---|---|---|
| JP | 2991373 | B1 | 12/1999 |
| JP | 2000-256945 | A | 9/2000 |
| JP | 2003-055865 | A | 2/2003 |
| JP | 4584343 | B1 | 11/2010 |
| JP | 2010-281013 | A | 12/2010 |
| JP | 2012-207311 | A | 10/2012 |

* cited by examiner

BRUSHED CIRCULAR KNITTED FABRIC

TECHNICAL FIELD

This disclosure relates to a brushed circular knitted fabric and, more specifically, to a brushed circular knitted fabric having resiliency feeling and stretchability suitable for use in a coat or jacket, and is excellent also in physical properties such as pilling resistance and changes in dimensions with washing.

BACKGROUND

Conventionally, in a coat or jacket for winter, since it is required to have water repellency and to be durable and high in heat retention, textile materials (melton fabrics), prepared by making a wool spun yarn into a plain weave or twill weave, then milling the weave and covering it with fluffs, are frequently used. However, because its raw material is wool, there are problems such as high cost and difficulty in handling such as being easily attached with insects and being easily damaged.

As a substitute therefor, many brushed materials using synthetic fibers are sold on the market. One is a brushed double-sided circular knitted fabric formed as a reversible double-sided circular knitted fabric formed from a thread for brushing, a thread for pressing, a thread for a ground fabric tissue or a thread for brushing, and a thread for pressing, inside the knit stitch due to the thread for brushing which forms one surface, the knit stitches due to the threads for pressing are formed into a double knit stitch having similar shapes, the thread for brushing is joined to the knit stitch forming the other surface by a tuck stitch, and at least one surface of the knit stitch forming surfaces formed by the thread for brushing is brushed (JP-B-2991373). In that fabric, although the problems with handling are solved since brushed fluffs are difficult to come off and it is excellent in physical properties such as pilling resistance, because the fabric has a drape property peculiar to a circular knitted fabric, the fabric is too soft and, further, because its stretchability is too great, there is a problem that it is not suitable for use in a coat or jacket for winter.

There also is a brushed woven fabric wherein a woven fabric is formed by arranging a high-shrinkage yarn having a boiling water shrinkage of 10% or more as warp and/or weft threads and at least one surface of the woven fabric is brushed (JP-A-HEI 5-287667). In that brushed woven fabric, there is a resiliency feeling because it is a woven fabric, but there is a problem that there is almost no stretchability, and although the problem can be solved by using a spandex to exhibit stretchability, there is a problem that the durability is poor because the spandex is easily deteriorated.

From such reasons, a brushed circular knitted fabric of synthetic fibers capable of being substituted for a wool melton fabric, having moderate resiliency feeling and stretchability and excellent also in physical properties such as pilling resistance and changes in dimensions with washing, has not been proposed.

It could therefore be helpful to provide a brushed circular knitted fabric having resiliency feeling and stretchability suitable for use in a coat or jacket, and excellent also in physical properties such as pilling resistance and changes in dimensions with washing.

SUMMARY

We thus provide:

(1) A brushed circular knitted fabric characterized in that the brushed circular knitted fabric is a circular knitted fabric having double loops stacked with at least two kinds of synthetic fiber multifilaments including a synthetic fiber multifilament A and a synthetic fiber multifilament B, at least one surface of the circular knitted fabric has undergone brush processing, and an index represented by equation (FT index) is 2.1 or greater:

$$\text{FT index}=T2/T1$$

T1: thickness (of one layer) according to JIS L 1096 8.4 method A

T2: thickness according to the same method prescribed by the above-described JIS at a state where the fabric is folded in two.

(2) The brushed circular knitted fabric according to (1), wherein a compressive elastic modulus of the circular knitted fabric having the double loops is 82% or more.

(3) The brushed circular knitted fabric according to (1) or (2), wherein the inside of double loops comprises a synthetic fiber multifilament A having a boiling water shrinkage of 12 to 30%, and the outside thereof comprises a synthetic fiber multifilament B having a boiling water shrinkage of less than 12%.

(4) The brushed circular knitted fabric according to any one of (1) to (3), wherein in a surface having the double loops, a ratio of the double loops is 30% or more.

(5) The brushed circular knitted fabric according to any one of (1) to (4), wherein a stitch length of the synthetic fiber multifilament A is shorter than a stitch length of the synthetic fiber multifilament B by 20% or more.

(6) The brushed circular knitted fabric according to any one of (1) to (5), wherein the synthetic fiber multifilament B comprises a synthetic fiber multifilament combined with two or more kinds of threads different in dyeability from each other.

(7) The brushed circular knitted fabric according to any one of (1) to (6), wherein a surface of the circular knitted fabric having undergone brush processing is performed with a surface smoothing processing.

(8) The brushed circular knitted fabric according to any one of (1) to (7), wherein at least one surface of the circular knitted fabric is water repellent finished.

(9) The brushed circular knitted fabric according to any one of (1) to (8), wherein the circular knitted fabric is a double-sided circular knitted fabric.

(10) The brushed circular knitted fabric according to any one of (1) to (9), wherein the circular knitted fabric has stitches formed from the synthetic fiber multifilament A on both sides of the knitted fabric.

(11) The brushed circular knitted fabric according to any one of (1) to (10), wherein the synthetic fiber multifilament B forming the double loops is joined to a knit stitch forming the other surface of the circular knitted fabric by a tuck stitch.

By being excellent in physical properties such as pilling resistance and changes in dimensions with washing and having moderate resiliency feeling and stretchability, our brushed circular knitted fabric optimal can be used optimally for an outer garment such as a coat or jacket.

EXPLANATION OF SYMBOLS

Figure 1:
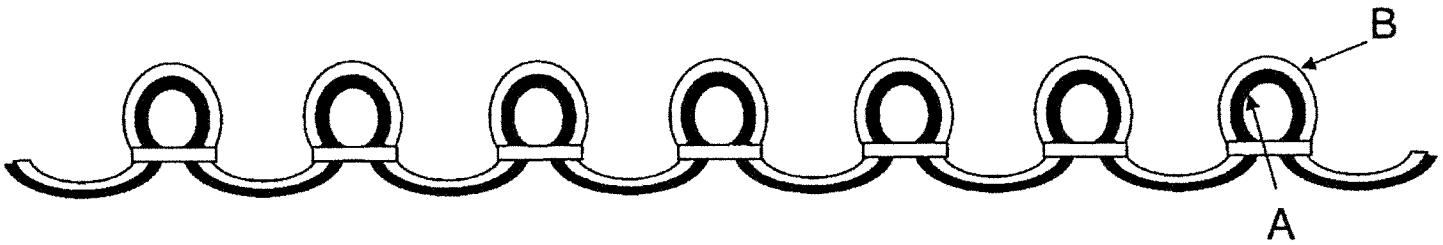
FIG. 1 is a schematic diagram showing an example of double looped threads in a brushed circular knitted fabric according to an Example.

A, B, C: thread used for circular knitted fabric
a: knit stitch
b: tuck stitch

DETAILED DESCRIPTION

Hereinafter, our brushed circular knitted fabric will be explained in detail with reference to the drawings, together with examples.

The brushed circular knitted fabric is a circular knitted fabric having double loops stacked with at least two kinds of synthetic fiber multifilaments.

It is necessary that the brushed circular knitted fabric has stitches that become double loops each stacked with two kinds of threads composed of a synthetic fiber multifilament A (hereinafter, also referred to as "thread A") forming the inside of the double loop and a synthetic fiber multifilament B (hereinafter, also referred to as "thread B") forming the outside thereof. In the brushed circular knitted fabric, it is also important that at least one surface is served to brush processing, and when brush processing is performed, mainly the outer threads of double loops are brushed. Therefore, even if brush processing is strongly performed, the strength of the fabric can be maintained.

Further, in the brushed circular knitted fabric, it is necessary that an index represented by equation (FT index) is 2.1 or greater:

$$\text{FT index}=T2/T1$$

T1: thickness (of one layer) according to JIS L 1096 8.4 method A

T2: thickness according to the same method prescribed by the above-described JIS at a state there the fabric is folded in two.

The greater the FT index is, the higher the resiliency feeling and the elasticity of the fabric become, the fabric becomes a material suitable for a coat or jacket for winter. It is necessary that the FT index is 2.1 or greater, and preferably it is 2.5 or greater.

Further, in the brushed circular knitted fabric, it is preferred that the compressive elastic modulus prescribed by JIS L 1096 8.20 is 82% or more. By satisfying that the compressive elastic modulus is 82% or more, a fabric more excellent in resiliency feeling, elasticity and resilient feeling can be obtained. Although the compression ratio is not particularly specified, in general, if it is 75% or more, the fabric can have a feeling of fullness and is preferable as an outer garment.

It is preferred that the brushed circular knitted fabric further satisfies the following.

First, it is preferred that the thread A forming the inside of the double loop is a synthetic fiber multifilament A having a boiling water shrinkage of 12 to 30%, and the thread B forming the outside thereof is a synthetic fiber multifilament B having a boiling water shrinkage of less than 12%. If such a condition is satisfied, the thread A shrinks more than the thread B after dyeing, whereby the thread B rises and becomes easy to be brushed, it becomes possible to make a fabric having a feeling of fullness and, as a result, the elasticity and resilient feeling can be enhanced, thereby realizing a target fabric. Further, because the densities in the warp and weft directions can be increased by the high shrinkage ratio, the fabric can be made as one having a resiliency feeling.

When the boiling water shrinkage of the thread A is less than 12%, the shrinkage difference with the thread B becomes small, the feeling of fullness as a fabric is poor, a sufficient resiliency feeling cannot be obtained, and if the boiling water shrinkage is higher than 30%, the shrinkage of the fabric is too large, there is a problem that the texture is hardened and the areal weight become too heavy. The boiling water shrinkage of the thread A is preferably in a range of 15 to 25%.

The thread A preferably satisfies the following constitutions and conditions except being a synthetic fiber multifilament with a boiling water shrinkage of 12 to 30%.

As the material, by using a general high shrinkable yarn of polyester or nylon, a moderate shrinkage can be given and, further, because fastness and physical properties required for garments can be satisfied, such a material can be preferably used.

With respect to the fineness of the thread A, if too thin, the feeling of fullness and the resiliency feeling are not exhibited, and if too thick, the fabric becomes too heavy and, therefore, it is preferably 30 to 170 dtex, and more preferably 50 to 120 dtex.

As the fineness of a single filament of the thread A, if too thin, the resiliency feeling is hard to be exhibited, and if too thick, the fabric becomes too solid and, therefore, it is preferably 1 to 35 dtex, and more preferably 2 to 15 dtex.

With respect to the fiber cross section of the thread A, although it is not particularly limited, a round cross section, a modified cross section, a hollow cross section and the like are preferably used and, further, a different shrinkage mixed yarn and a different shrinkage and spinning mixed yarn, in which a high shrinkage yarn and a normal shrinkage yarn are mixed, can also be preferably used.

The higher the mixing ratio of the thread A relative to the knitted fabric is, the more highly the resiliency feeling can be enhanced and, therefore, it is preferably 20% or more, and more preferably 30% or more.

Further, by employing the aforementioned structures, it is possible to give a suitable stretchability. By employing a synthetic fiber multifilament having a boiling water shrinkage of 12 to 30% as the thread A forming the inside of the double loop, the density of the knitted fabric can be adequately enhanced, and by controlling finishing conditions of the post-processing, the stretchability required for the brushed circular knitted fabric can be controlled at 15% or more and less than 80%. More desirably, it is preferable to control it at 30% or more and less than 50%. When the stretchability is less than 15%, there is a tension feeling at the time of being worn due to a lack of stretch as a knitted fabric, and when 80% or more, elongation of the fabric is too large, and it becomes poor in tailored appearance when it is made into an outer garment.

As the thread B, it preferably satisfies the following constitutions and conditions except being a synthetic fiber multifilament with a boiling water shrinkage of less than 12%.

As the material of the thread B, it is preferably a polyester or a nylon among synthetic fibers.

The thread B is preferably a filamentary yarn if it is desired to increase the pilling resistance, and the fineness of the thread B is preferably 40 to 230 dtex, more preferably 50 to 170 dtex since, if it is too thin, the feeling of fullness is not exhibited and, if too thick, the fabric becomes too heavy.

The fineness of a single filament of the thread B is preferably 0.8 to 8 dtex, more preferably 0.7 to 5 dtex since, if it is too thin, the resiliency feeling is hard to be exhibited and, if too thick, the texture becomes too hard.

Further, by using a synthetic fiber multifilament combined with two or more kinds of yarns having different dyeabilities, various mottled patterns of various colors can be easily realized. As the processing method for combining the yarns, air fiber mixing processing, twisting processing or the like can be used depending upon the purpose.

In the brushed circular knitted fabric, it is also important that at least one surface is brushed. Since the threads are fuzzed by the brushing, the texture is soft, there is a feeling of fullness, and the heat retention can be enhanced. Furthermore, when the feeling of fullness and the heat retention are required to be further enhanced, it is preferred to brush both surfaces of the front and back surfaces.

With respect to the stitch length L of the brushed circular knitted fabric, it is preferred that that of the synthetic fiber multifilament A is shorter than that of the synthetic fiber multifilament B by 20% or more. The stitch length L is calculated by as follows:

$$L=l/s$$

L: stitch length l: length of thread between 100 wells of knitted fabric s: number of knit stitches between 100 wells of knitted fabric.

By making the stitch length of the synthetic fiber multifilament A shorter by 20% or more, because the difference between the synthetic fiber multifilament A and the synthetic fiber multifilament B can be made greater after dyeing, the synthetic fiber multifilament B is further raised and brushing can be performed more easily and a fabric having a feeling of fullness can be realized. This difference in stitch length is more preferably 25% or more, and further preferably 30% or more.

The structure of the brushed circular knitted fabric is not particularly limited as long as the double loop stacked with the synthetic fiber multifilament A and the synthetic fiber multifilament B is formed, but it is preferred that the ratio of double loops is 30% or more in the surface having the double loops. If the rate of courses having double loops is small, the density of brushed bristles becomes too low, and results in a fabric poor in appearance and poor in feeling of fullness. The ratio is further preferably 50% or more, and most preferably it is 100%.

Further, it is preferred to employ a structure that easily gives a difference in stitch length between the synthetic fiber multifilament A and the synthetic fiber multifilament B, and a double-sided circular knitted fabric is more preferable because a resiliency feeling can be easily exhibited.

In a double-sided circular knitted fabric, the resiliency feeling can be better enhanced by having stitches comprising synthetic fiber multifilaments A on both surfaces of the knitted fabric.

Figure 2:
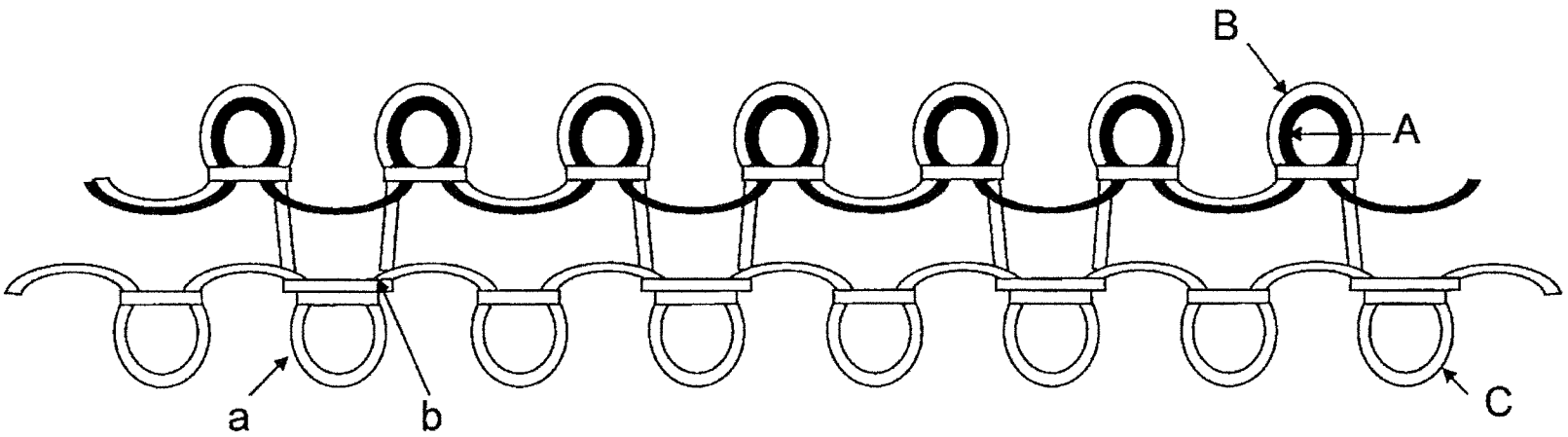
FIG. 2 is a schematic diagram showing an example of a double-sided circular knitted fabric usable for a brushed circular knitted fabric according to an Example.
Figure 3:
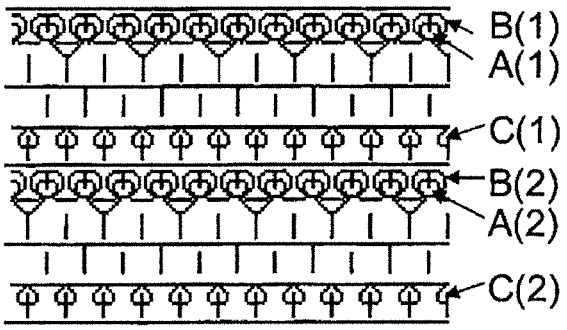
FIG. 3 is an organization chart showing an example of a circular knitted fabric used in an Example of a brushed circular knitted fabric according to an Example.
Figure 5:
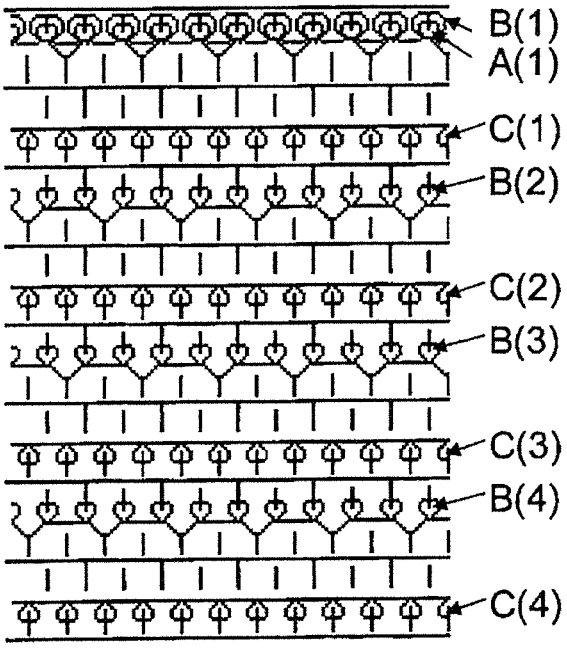
FIG. 5 is an organization chart showing an example of a circular knitted fabric used in a brushed circular knitted fabric of a Comparative Example.

Although the structure of the double-sided circular knitted fabric is not particularly limited except a structure having double loops, preferred is a structure wherein the difference between the stitch length of the inner thread and the outer thread of the double loop is easily made large. As a concrete preferable structure, there is a circular knitted structure in which there are a thread A forming the inside and a thread B forming the outside as shown in FIG. 2, and the thread B forming the outside is joined to a knit stitch a by a tuck stitch b as a thread C forming the other surface. FIG. 3 is an organization chart showing an example of this knit structure (exemplified with threads A(1), (2), threads B(1), (2), and threads C(1), (2)). Further, a knit structure called as a brush as shown in the organization chart of FIG. 5 is also preferable (exemplified with thread A(1), threads B(1), (2), (3), (4), and threads C(1), (2), (3), (4)).

Although the knitting machine is not particularly limited, it is preferred to be 18 to 32 gauge to enhance the resiliency feeling.

The dyeing method of a knitted fabric already knitted as a gray fabric may be carried out according to the dyeing process and processing method of an ordinary circular knitted fabric as long as the brush processing is carried out. With respect to the brush processing, the feeling of fullness is exhibited more easily when it is carried out before dyeing, and a more uniform brushing can be achieved when it is carried out after dyeing.

Further, as a processing step, it is also possible to perform a surface smoothing processing to a surface having undergone brush processing with a heat or a pressure or both. By performing the surface smoothing processing, it becomes possible to suppress a pilling or to exhibit a glossy feeling.

Furthermore, as additional processing in the dyeing stage, it is preferred to appropriately provide it depending upon the desired aim of the intended purpose or the required properties in the use such as water repellent finishing, antifouling processing, sweat absorbing processing, antibacterial processing, deodorizing processing, anti-odor finishing, flame retardant processing or the like.

In particular, when at least one surface is water repellent finished, when made into a coat, a jacket or the like, because water such as rain does not permeate, it can be preferably used. The water repellency is preferably second grade or higher in the water repellency test prescribed in JIS L 1092 7.2 "Spray test" determined after washing treatment or dry cleaning treatment.

EXAMPLES

Hereinafter, our fabrics will be explained in more detail based on Examples, but this disclosure is not limited to these Examples. The respective physical properties in the Examples were determined by the following methods.

(1) FT index:

$$\text{FT index}=T2/T1$$

T1: thickness (of one layer) according to JIS L 1096 8.4 method A

T2: thickness according to the same method prescribed by the above-described JIS at a state where the fabric is folded in two.

The thickness of the fabric is measured based on JIS L 1096 8.4 method A (2014 version) (as to the load, a load for knit is used). Further, as to the method of measuring the fabric folded in two, the fabric is folded in two along the longitudinal ridge so that the skin side when worn is placed inside, and it is measured at a state set so that the folded part comes to the center of the measuring disk of the thickness measuring instrument. Furthermore, when folding the fabric, sufficient attention is paid to not apply unnecessary force to the folded part.

(2) Compressive elastic modulus:

It was determined based on JIS L 1096 8.20 (2014 version).

(3) Boiling water shrinkage:

An original length (L0) of a fabric is measured under a load of 0.1 g/d, and the fabric is immersed in boiling water without load for 15 minutes. After the boiling water treatment, the length (L1) after treatment is measured again with a load of 0.1 g/d. Boiling water shrinkage is determined as follows:

$$\text{Boiling water shrinkage}=\{L0-L1/L0\}\times 100(\%)$$

(4) Stitch length:

The stitch length L is calculated as follows:

$$L=l/s$$

L: stitch length l: length of thread between 100 wells of knitted fabric s: number of knit stitches between 100 wells of knitted fabric.

The length of thread between 100 wells of knitted fabric is determined by loosening a thread to be determined, applying a weight of 0.1 g/d to the thread, and measuring the length of the thread corresponding to 100 wells of the knitted fabric. Further, the number of knit stitches between 100 wells of knitted fabric is defined as the number of knit stitches on the measured thread corresponding to 100 wells.

(5) Water repellent durability:

After washing treatment or dry cleaning treatment, it was determined by the water repellency test method prescribed in JIS L 1092 7.2 "Spray test" (2014 version).

(6) Piling resistance:

It is determined in accordance with JIS L 1076 8.1.1 "Method using ICI type testing machine" (2014 version). The determination value (grade) and the pilling occurrence degree are based on the following grades:

Grade 5: Almost no occurrence of pilling.

Grade 4: There are a few occurrences of pilling.

Grade 3: There are occurrences of pilling.

Grade 2: There are many occurrences of pilling.

Grade 1: There are remarkably many occurrences of piling.

(7) Change rate in dimensions with washing:

It was determined based on JIS L 1096 8.39 method G "Pulsator type household electric washing machine method" (2014 version). The change rate in dimensions was determined as follows:

+1 to −3%: ○

+1 to 1.5%, −3 to −5%: Δ

+1.5% or more, −5% or more: x

※)+ means elongation direction, and − means shrinkage direction.

(8) Stretchability:

It was determined based on JIS L 1096 8.16.1 method D "Cut slip method" (2014 version). The stretchability was determined as follows:

30% or more and less than 50%: ○

15% or more and less than 30%, 50% or more and less than 80%: Δ less than 15%, 80% or more: x.

(9) Sensory evaluation:

Tactile evaluations of a knitted fabric with respect to fabric feeling (resiliency feeling, elasticity and resilient feeling), fabric surface quality and comprehensive evaluation are performed for each of 15 males and females, and the determination is carried out according to the following criteria:

◎: very excellent, ○: excellent, Δ: poor, x: very poor.

Example 1

Using a 22G double-sided circular knitting machine, a polyester gray yarn of 84 dtex and 12 filaments and having a boiling water shrinkage of 12.5% was used for threads A(1), A(2) forming the inside of the double loop in the structure shown in FIG. 3, a polyester false-twist processed yarn of 110 dtex and 96 filaments and having a boiling water shrinkage of 6.0% was used for threads B(1), B(2) forming the outside of the double loop, and a polyester gray yarn of 84 dtex and 12 filaments and having a boiling water shrinkage of 12.5% was used at a state of being combined with two yarns for threads C(1), C(2) forming the opposite surface to the surface of the double loop, to knit a knitted fabric.

After relaxing, scouring and dyeing the gray fabric according to an ordinary dyeing processing method for a polyester knitted fabric, a brushing process was carried out on the surface having the double loops, a water repellent agent was applied, and the fabric was subjected to a finishing set processing to obtain a brushed circular knitted fabric (areal weight: 380 g/m$^2$).

The stitch length of thread A was 2.9 mm, the stitch length of thread B was 5.4 mm, the thread A was 46.3% shorter than the thread B, the mixing ratio of the polyester gray yarn having a boiling water shrinkage of 12.5% was 54.4%.

Further, FT index was 3.2, compressive elastic modulus was 87.5%, pilling was grade 3-4, change rate in dimensions with washing was −1.8% which was "○," and stretchability was 40% which was "○."

The evaluation results of this brushed circular knitted fabric are shown in Table 1.

Example 2

Using a 22G double-sided circular knitting machine, a polyester gray yarn of 84 dtex and 12 filaments and having a boiling water shrinkage of 12.5% was used for threads A(1), A(2) forming the inside of the double loop in the structure shown in FIG. 3 and threads C(1), C(2) forming the opposite surface to the surface of the double loop, and a polyester false-twist processed yarn of 98 dtex and 72 filaments and having a boiling water shrinkage of 2.5%, in which a polyester to be dyed with a cationic dye and a polyester to be dyed with a disperse dye were combined, was used for threads B(1), B(2) forming the outside of the double loop, to knit a knitted fabric.

After relaxing, scouring and dyeing the gray fabric according to an ordinary dyeing processing method for a polyester knitted fabric, a brushing process was carried out on both surfaces, and the fabric was subjected to a finishing set processing to obtain a brushed circular knitted fabric (areal weight: 285 g/m$^2$).

The stitch length of thread A was 2.8 mm, the stitch length of thread B was 3.9 mm, the thread A was 28.2% shorter than the thread B, the mixing ratio of the polyester gray yarn having a boiling water shrinkage of 12.5% was 55.3%.

Further, FT index was 2.2, compressive elastic modulus was 86%, pilling was grade 4, change rate in dimensions with washing was −2.7% which was "○," and stretchability was 52% which was "Δ."

The evaluation results of this brushed circular knitted fabric are shown in Table 1.

Example 3

Figure 4:
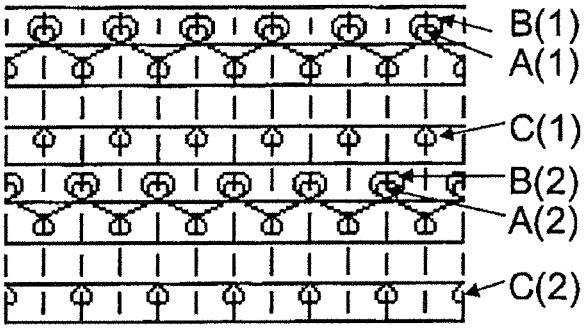
FIG. 4 is an organization chart showing another example of a circular knitted fabric used in an Example of a brushed circular knitted fabric.

Using a 28G double-sided circular knitting machine, a polyester gray yarn of 84 dtex and 12 filaments and having a boiling water shrinkage of 19.2% was used for threads A(1), A(2) forming the inside of the double loop in the structure shown in FIG. 4, a polyester false-twist processed yarn of 110 dtex and 96 filaments and having a boiling water shrinkage of 6.0% was used for threads B(1), B(2) forming the outside of the double loop, and a polyester false-twist processed yarn of 84 dtex and 36 filaments and having a boiling water shrinkage of 5.5% was used for threads C(1), C(2) forming the opposite surface to the surface of the double loop, to knit a knitted fabric.

After relaxing, scouring and dyeing the gray fabric according to an ordinary dyeing processing method for a polyester knitted fabric, a brushing process was carried out on the surface having the double loops, a water repellent agent was applied, and the fabric was subjected to a finishing set processing to obtain a brushed circular knitted fabric (areal weight: 350 g/m$^2$).

The stitch length of thread A was 2.4 mm, the stitch length of thread B was 5.1 mm, the thread A was 52.9% shorter than the thread B, the mixing ratio of the polyester gray yarn having a boiling water shrinkage of 19.2% was 31.3%.

Further, FT index was 2.7, compressive elastic modulus was 86%, pilling was grade 4, change rate in dimensions with washing was −2.8% which was "○," and stretchability was 27% which was "Δ."

The evaluation results of this brushed circular knitted fabric are shown in Table 1.

Example 4

Using a 28G double-sided circular knitting machine, a polyester gray yarn of 84 dtex and 12 filaments and having a boiling water shrinkage of 19.2% was used for threads A(1), A(2) forming the inside of the double loop in the structure shown in FIG. 3, a polyester false-twist processed yarn of 110 dtex and 96 filaments and having a boiling water shrinkage of 6.0% was used for threads B(1), B(2) forming the outside of the double loop, and a polyester false-twist processed yarn of 84 dtex and 36 filaments and having a boiling water shrinkage of 5.5% was used for threads C(1), C(2) forming the opposite surface to the surface of the double loop, to knit a knitted fabric.

After relaxing, scouring and dyeing the gray fabric according to an ordinary dyeing processing method for a polyester knitted fabric, a brushing process was carried out on the surface having the double loops, a water repellent agent was applied, and the fabric was subjected to a finishing set processing to obtain a brushed circular knitted fabric (areal weight: 394 g/m$^2$).

The stitch length of thread A was 2.4 mm, the stitch length of thread B was 4.6 mm, the thread A was 47.8% shorter than the thread B, the mixing ratio of the polyester gray yarn having a boiling water shrinkage of 19.2% was 23.5%.

Further, FT index was 2.6, compressive elastic modulus was 83%, pilling was grade 4, change rate in dimensions with washing was −2.5% which was "○," and stretchability was 30% which was "○."

The evaluation results of this brushed circular knitted fabric are shown in Table 1.

Comparative Example 1

Using a 28G double-sided circular knitting machine, a polyester gray yarn of 84 dtex and 12 filaments and having a boiling water shrinkage of 9.1% was used for thread A(1) forming the inside of the double loop in the structure shown in FIG. 5, a polyester false-twist processed yarn of 110 dtex and 96 filaments and having a boiling water shrinkage of 6.0% was used for thread B(1) forming the outside of the double loop, a polyester false-twist processed yarn of 110 dtex and 96 filaments and having a boiling water shrinkage of 6.0% was used for threads B(2), B(3), B(4) which did not form double loops, and a polyester false-twist processed yarn of 84 dtex and 36 filaments and having a boiling water shrinkage of 5.5% was used for threads C(1), C(2), C(3), C(4) forming the opposite surface to the surface of the double loop, to knit a knitted fabric.

After relaxing, scouring and dyeing the gray fabric according to an ordinary dyeing processing method for a polyester knitted fabric, a brushing process was carried out on the surface having the double loops, and the fabric was subjected to a finishing set processing to obtain a brushed circular knitted fabric (areal weight: 292 g/m$^2$).

The stitch length of thread A was 2.4 mm, the stitch length of thread B was 4.9 mm, the thread A was 51% shorter than the thread B, but synthetic fiber multifilaments having a boiling water shrinkage of 12 to 30% were not used.

Further, FT index was 2.0, compressive elastic modulus was 80%, pilling was grade 3, change rate in dimensions with washing was −3.2% which was "Δ," and stretchability was 53% which was "Δ."

The evaluation results of this brushed circular knitted fabric are shown in Table 1.

Comparative Example 2

Figure 6:
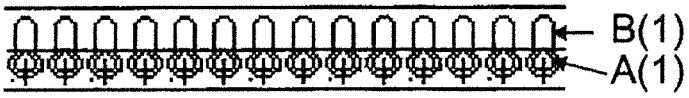
FIG. 6 is an organization chart showing another example of a circular knitted fabric used in a brushed circular knitted fabric of a Comparative Example.

Using a 28G single circular knitting machine, a polyester false-twist processed yarn of 84 dtex and 72 filaments and having a boiling water shrinkage of 5.1% was used for thread A(1) in the structure shown in FIG. 6, and a polyester false-twist processed yarn of 110 dtex and 144 filaments and having a boiling water shrinkage of 4.8% was used for thread B(1), to knit a knitted fabric.

After relaxing, scouring and dyeing the gray fabric according to an ordinary dyeing processing method for a polyester knitted fabric, a brushing process was carried out on the surface having piles, and the fabric was subjected to a finishing set processing to obtain a brushed circular knitted fabric (areal weight: 309 g/m$^2$).

The stitch length of thread A was 2.6 mm, the stitch length of thread B was 4.9 mm, the thread A was 46.9% shorter than the thread B, but synthetic fiber multifilaments having a boiling water shrinkage of 12 to 30% were not used.

Further, FT index was 1.9, compressive elastic modulus was 88%, pilling was grade 2, change rate in dimensions with washing was −5.5% which was "x," and stretchability was 93% which was "x."

The evaluation results of this brushed circular knitted fabric are shown in Table 1.

Comparative Example 3

Figure 7:
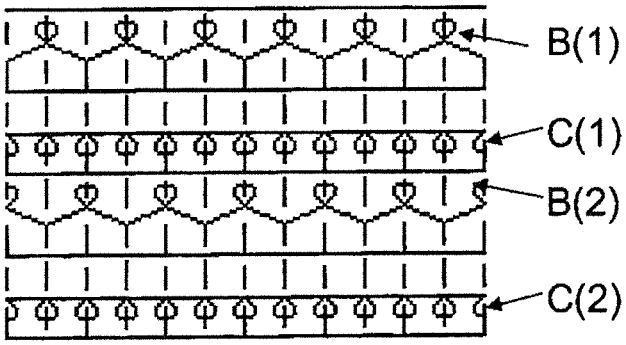
FIG. 7 is an organization chart showing a further example of a circular knitted fabric used in a brushed circular knitted fabric of a Comparative Example.

Using a 28G double-sided circular knitting machine, a polyester false-twist processed yarn of 84 dtex and 72 filaments and having a boiling water shrinkage of 5.1% was used for threads B(1), B(2) in the structure shown in FIG. 7, and a polyester false-twist processed yarn of 110 dtex and 48 filaments and having a boiling water shrinkage of 5.3% was used for threads C(1), C(2), to knit a knitted fabric.

After relaxing, scouring and dyeing the gray fabric according to an ordinary dyeing processing method for a polyester knitted fabric, a brushing process was carried out on the surface using threads B, and the fabric was subjected to a finishing set processing to obtain a brushed circular knitted fabric (areal weight: 250 g/m$^2$).

In this knitted fabric, there was no double loops, and synthetic fiber multifilaments having a boiling water shrinkage of 12 to 30% were not used.

Further, FT index was 1.9, compressive elastic modulus was 81%, pilling was grade 2, change rate in dimensions with washing was −3.2% which was "Δ," and stretchability was 83% which was "x."

The evaluation results of this brushed circular knitted fabric are shown in Table 1.

Comparative Example 4

Figure 8:
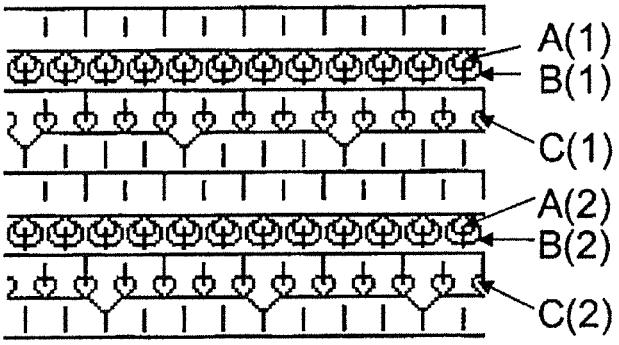
FIG. 8 is an organization chart showing a still further example of a circular knitted fabric used in a brushed circular knitted fabric of a Comparative Example.

Using a 28G double-sided circular knitting machine, a polyester gray yarn of 84 dtex and 12 filaments and having a boiling water shrinkage of 12.5% was used for threads A(1), A(2) forming the inside of the double loop in the structure shown in FIG. 8, a polyester false-twist processed yarn of 84 dtex and 72 filaments and having a boiling water shrinkage of 5.1% was used for threads B(1), B(2) forming the outside of the double loop, and a polyester false-twist processed yarn of 84 dtex and 36 filaments and having a boiling water shrinkage of 5.5% was used for threads C(1), C(2) forming the opposite surface to the surface of the double loop, to knit a knitted fabric.

After relaxing, scouring and dyeing the gray fabric according to an ordinary dyeing processing method for a polyester knitted fabric, a brushing process was carried out on the surface having the double loops, and the fabric was subjected to a finishing set processing to obtain a brushed circular knitted fabric (areal weight: 300 g/m$^2$).

The stitch length of thread A was 2.3 mm, the stitch length of thread B was 2.7 mm, the thread A was 14.8% shorter than the thread B, but the mixing ratio of the polyester gray yarn having a boiling water shrinkage of 12.5% was 29%.

Further, FT index was 2.0, compressive elastic modulus was 83%, pilling was grade 3, change rate in dimensions with washing was −2.8% which was "○," and stretchability was 55% which was "Δ."

The evaluation results of this brushed circular knitted fabric are shown in Table 1.

TABLE 1

| | Structure | Used yarn | High-shrinkage yarn mixing ratio | Double loop length | Difference | FT index | Compressive elastic modulus |
|---|---|---|---|---|---|---|---|
| Example 1 | 22G double | 84T-12-high-shrinkage yarn<br>110T-96-processed yarn | 54.4 | 2.9<br>5.4 | 46.3 | 3.2 | 87.5 |
| Example 2 | 22G double | 84T-12-high-shrinkage yarn<br>98T-72-CDP mixed filamentary yarn | 55.3 | 2.8<br>3.9 | 28.2 | 2.2 | 86 |
| Example 3 | 28G double | 84T-12-high-shrinkage yarn<br>110T-96-processed yarn<br>84T-36-processed yarn | 31.3 | 2.4<br>5.1<br>— | 52.9 | 2.7 | 86 |
| Example 4 | 28G double | 84T-12-high-shrinkage yarn<br>110T-96-processed yarn<br>84T-36-processed yarn | 23.5 | 2.4<br>4.6 | 47.8 | 2.6 | 83 |
| Comparative Example 1 | 28G double | 84T-12-ordinary gray yarn<br>110T-96-processed yarn<br>84T-36-processed yarn | — | 2.4<br>4.9 | 51 | 2.0 | 80 |
| Comparative Example 2 | 28G single | 84T-72-processed yarn<br>110T-144-processed yarn | — | 2.6<br>4.9 | 46.9 | 1.9 | 88 |
| Comparative Example 3 | 28G double | 84T-72-processed yarn<br>110T-48-processed yarn | — | —<br>— | — | 1.9 | 81 |
| Comparative Example 4 | 28G double | 84T-12-high-shrinkage yarn<br>84T-72-processed yarn<br>84T-36-processed yarn | 29 | 2.3<br>2.7 | 14.8 | 2.0 | 83 |

| | Pilling | Change rate in dimensions | Stretchability | Sensory evaluation: Fabric feeling | Surface feeling | Comprehensive evaluation |
|---|---|---|---|---|---|---|
| Example 1 | 3-4 | ○ | ○ | ◎ | ◎ | ◎ |
| Example 2 | 4 | ○ | Δ | ○ | ○ | ○ |
| Example 3 | 4 | ○ | Δ | ○ | ◎ | ◎ |
| Example 4 | 4 | ○ | ○ | ○ | ○ | ○ |
| Comparative Example 1 | 3 | Δ | Δ | Δ | X | X |
| Comparative Example 2 | 2 | X | X | X | Δ | X |
| Comparative Example 3 | 2 | Δ | X | X | X | X |
| Comparative Example 4 | 3 | ○ | Δ | Δ | Δ | Δ |

INDUSTRIAL APPLICABILITY

In outer applications such as a coat or a jacket, a brushed circular knitted fabric having moderate resiliency feeling and stretchability and good in physical properties such as pilling resistance and changes in dimensions with washing can be obtained, and it can be used for various garment applications.

The invention claimed is:

1. A brushed circular knitted fabric comprising double loops formed from at least two kinds of synthetic fiber multifilaments including a synthetic fiber multifilament A laid on a synthetic fiber multifilament B, wherein 1) an inside portion of the double loops comprises a synthetic fiber multifilament A having a boiling water shrinkage of 12 to 30% and an outside portion comprises a synthetic fiber multifilament B having a boiling water shrinkage of less than 12%, 2) at least one surface of said circular knitted fabric has undergone heating that shrinks the synthetic fiber multifilaments A and B and then brush processing, 3) an index represented by equation (FT index) is 2.1 or greater, and 4) a stitch length of said synthetic fiber multifilament A is shorter than a stitch length of said synthetic fiber multifilament B by 20% or more:

$$\text{FT index}=T2/T1$$

T1: thickness (of one fabric layer) according to JIS L 1096 8.4 method A

T2: thickness of a folded part of the circular knitted fabric in a state where the circular knitted fabric is folded in two according to the same method prescribed by the above-described JIS.

2. The brushed circular knitted fabric according to claim 1, wherein a compressive elastic modulus of said double loops is 82% or more.

3. The brushed circular knitted fabric according to claim 1, wherein, in a surface containing said double loops, an amount of the double loops is 30% or more based on the total number of loops in the surface.

4. The brushed circular knitted fabric according to claim 1, wherein said synthetic fiber multifilament B comprises a synthetic fiber multifilament combined with two or more kinds of filaments different in dyeability from each other.

5. The brushed circular knitted fabric according to claim 1, wherein a surface of said circular knitted fabric having undergone brush processing is performed with a surface smoothing processing.

6. The brushed circular knitted fabric according to claim 1, wherein at least one surface of said circular knitted fabric is coated with water repellent.

7. The brushed circular knitted fabric according to claim 1, having stitches formed from said synthetic fiber multifilament A on both sides of the knitted fabric.

8. The brushed circular knitted fabric according to claim 1, wherein said synthetic fiber multifilament B forming said double loops is joined to a knit stitch forming another surface of said circular knitted fabric by a tuck stitch.

* * * * *